United States Patent [19]

List

[11] 3,949,726

[45] Apr. 13, 1976

[54] INTERNAL COMBUSTION ENGINE WITH ENCASING

[76] Inventor: Hans List, 126, Heinrichstrasse, Graz, Austria

[22] Filed: Sept. 10, 1974

[21] Appl. No.: 504,761

[30] Foreign Application Priority Data

Apr. 3, 1974 Austria ..... 2792/74

[52] U.S. Cl...... 123/198 E; 123/41.7; 123/41.79; 181/33 K

[51] Int. Cl.[2]..... F02F 1/34; F02B 77/00

[58] Field of Search..... 123/198 E, 41.7, 41.79, 123/195 S, 195 C; 181/33 K

[56] References Cited

UNITED STATES PATENTS

| | | | |
|---|---|---|---|
| 2,123,358 | 7/1938 | Grutzner | 123/198 E |
| 2,177,687 | 10/1939 | Bracken et al. | 123/198 E |
| 3,155,082 | 11/1964 | Roorda et al. | 123/198 E |
| 3,464,398 | 9/1969 | Scheiterlein et al. | 123/198 E X |
| 3,521,726 | 7/1970 | Freyn | 123/198 E X |
| 3,684,053 | 8/1972 | Fachbach et al. | 123/198 E X |
| 3,855,976 | 12/1974 | Notaras et al. | 123/41.79 X |

*Primary Examiner*—Charles J. Myhre
*Assistant Examiner*—Ira S. Lazarus

[57] ABSTRACT

An internal combustion engine with an encasing surrounding the outer surfaces of the engine in spaced relation thereto, with a cooling-air inlet and a cooling-air outlet and a blower arranged within the encasing, the suction end of said blower communicating with the cooling-air inlet through an interposed air filter, the delivery end of the blower communicating with the cooling-air outlet.

4 Claims, 1 Drawing Figure

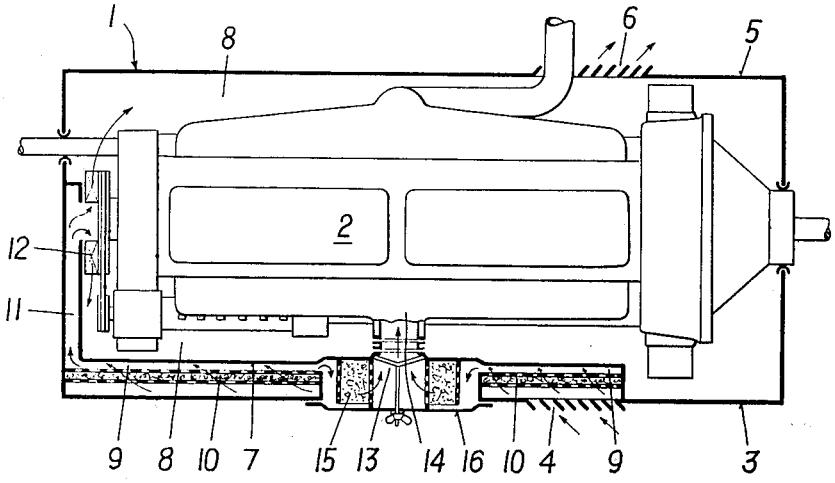
1
8
6
5
2
12
11
9
8
10
7
15
13
14
16
10
4
9
3

INTERNAL COMBUSTION ENGINE WITH ENCASING

The present invention relates to an internal combustion engine with an encasing surrounding the outer surfaces of the engine in spaced relation to same and ventilated by means of a blower, and comprising at least one cooling-air inlet and one cooling-air outlet.

With encased engines the exchange of heat between the outer surfaces of the engine and the environment is impaired by the encasing with the necessity to ventilate the space between the encasing and the engine by means of a blower for the purpose of removing the excess heat produced by the engine. Where these engines are operated in an environment where dust and similar impurities accumulate in sizeable quantities, regular cleaning of the surfaces is indispensable because dirt and dust layers in water-cooled engines obstruct the evacuation of heat from the outer surfaces of the engine,, whereas in air-cooled engines the transition of heat from the cooling fins of the cylinder heads and cylinder liners as well as of the lubricating-oil filter to the cooling-air is impaired. Moreover, impurities are a handicap for the engine maintenance operations.

Engines of both types of cooling systems comprising an entirely enclosed, blower-ventilated encasing equally risk fouling by polluted cooling air while the possibility of cleaning such areas of the engine surface as do not require particular maintenance and are therefore, generally of difficult access, is substantially reduced.

It is the purpose of the present invention to avoid these drawbacks of encased engines of the type herebefore described. According to the invention, the cooling-air supplied by the blower is directed through an air filter located in the area of the cooling-air inlet and/or cooling-air outlet. In this manner, deposits of dust and other impurities on the surfaces located within the encasing are reduced to the minimum, so that the exchange of heat between these areas and the blower air is not impaired and cleaning operations within the casing will have to be performed after considerable periods of time only. Filtering of the blower air also has a beneficial effect upon the maintenance standard and service life of such auxiliary machines and appliances of the engine as may be included in the encasing.

An essential advantage of the invention is its universal usefulness for encased, blower-ventilated engines of various types. Besides, such engines can be equipped according to the invention at a later stage, if desired, with the use of readily available filter materials.

According to another feature of the invention as applied to air-cooled internal combustion engines in particular for the purpose of avoiding detrimental effects of the air filter upon the quantity of cooling-air and/or upon blower performance, a large-size fine-mesh filter or a centrifugal filter is provided. Such filters, for example cyclone filters or oil-bath filters, are distinguished by a very low resistance to flow.

According to a preferred embodiment of the invention, the air filter associated with the blower and the intake air filter of the engine are jointly arranged in a chamber formed within the encasing wherein the cooling-air inlet terminates and from which the intake duct of the engine and a separate cooling-air duct leading to the blower emerge. This arrangement not only offers the advantage of compactness due to the fact that the two air filters are combined to form a single structural unit, but also that of a two-stage filtering of the air for combustion drawn in by the engine, since said air is branched off the main air flow delivered by the blower which had previously already passed the air filter assiciated with the blower. The increase in purity of the air for combustion naturally tends to reduce premature wear of the engine. Furthermore, it is possible to essentially extend the intervals of time during which the intake air filter requires cleaning or renewal.

With the last-mentioned type of internal combustion engine it is particularly advantageous, if according to another feature of the invention, the chamber is formed between the suction-end encasing wall and a parallel partition located within the encasing and the plate-shaped air filter associated with the blower is arranged between the parallel walls of the chamber, and if the intake air filter designed as an annular fine-mesh filter is located in front of an aperture of the partition terminating in the intake duct of the engine. It is therefore, possible to accommodate both a large-sized blower air filter and an intake air filter of a conventional type in a space-saving manner in the chamber without noticeably enlarging the contours of the encasing.

Further details of the invention will become apparent from the following description of a preferred embodiment of the invention with reference to the accompanying drawing wherein a top plan view of a water-cooled in-line internal combustion engine with an entirely closed encasing is shown, the latter being illustrated as a cross-sectional view.

The encasing 1 shown only schematically in the drawing surrounds the engine 2 like a closed housing and is connected thereto preferably in a sound-proofing manner. The suction-end encasing wall 3 has a louver-type cooling-air inlet 4 formed by a number of parallel inlet ports and the opposite encasing wall 5 presents a cooling-air outlet 6 of similar design.

Between the suction-end encasing wall 3 and a partition 7 located in parallel relation thereto and within the encasing 1 a chamber 9 separated from the rest of the interior 8 of the encasing is formed wherein the cooling-air inlet 4 terminates, said chamber 9 including a large-sized plate-shaped air filter 10 extending over the entire length and height of the chamber 9.

From the end of the chamber 9 opposite the cooling-air inlet 4 a cooling-air duct 11 leading to the suction-end of a blower 12 actuated by means of the engine 2 emerges, said blower communicating at the suction-end with the interior 8 of the encasing 1.

On the other side, the chamber 9 communicates through an aperture 13 of the partition 7 with the intake duct 14 of the engine 2. In the area around this aperture 13 the width of the chamber 9 is larger than the cross-sectional area of the rest of the chamber for the purpose of receiving the intake air filter 15 of the engine which is designed as an annular fine-mesh filter. The latter is accessible via a removable cover 16 of the encasing wall 3.

The cooling air drawn in by the blower 12 enters through the inlet 4 into the part of the chamber close to the encasing wall 3, flows through the air filter 10 over its entire surface and reaches that part of the chamber 9 which is close to the partition 7. The direction of the cooling-air flow is indicated by arrows.

Part of the cooling air is directed via the cooling-air duct 11 from the blower 12 into the interior 8 of the encasing 1 and emerges via the cooling-air outlet 6 from the encasing, the air sweeping over the outer surfaces of the engine 2 as well as the inner surfaces of the encasing 1 for the purpose of abducting excess engine heat.

The engine 2 draws in such air for combustion as is necessary for its operation also from the part of the chamber 9 close to the partition 7. After preliminary purification in the filter 10, the air passes in a radial direction through the annular intake air filter 15 and from there it flows through the aperture 13 into the intake duct 14 of the engine. It is thus possible to achieve a high degree of purity of the air for cumbustion as a result of which premature wear of the engine is largely avoided.

The underlying idea of the invention can be put into practice in a variety of ways as different from the design as hereabove described with reference to the accompanying drawing.

For example, it is possible to arrange both the cooling-air inlet and the air filter at the front end of the engine. According to other embodiments of the invention the filtering device is located at the delivery side of the blower. Finally, there is no limit to the design of the filter and the choice of the filter material.

I claim:

1. An internal combustion engine having an encasing surrounding the outer surfaces of the engine in spaced relation thereto through which cooling-air flows, at least one cooling-air inlet and one cooling-air outlet in said encasing, a cooling-air blower arranged in the encasing and having a suction end and a delivery end, the suction end of the cooling-air blower communicating with the cooling-air inlet, the delivery end of the cooling-air blower communicating with the cooling-air outlet, said engine comprising a chamber formed within said encasing and having two end portions opposed to each other, one end portion connected to said cooling-air inlet, the other end portion connected to the suction end of the cooling-air blower, and a cooling air filter located in the chamber in the path of the cooling-air flowing through the chamber.

2. An internal combustion engine according to claim 1, wherein said cooling air filter is a large area fine-mesh filter.

3. An internal combustion engine according to claim 1, with a suction pipe for the air for combustion to be delivered to the engine and a suction air filter preceding the suction air pipe, said chamber including also said suction air filter, said suction pipe of the engine emerging from said chamber, a separate cooling-air duct emerging from said chamber, and extending as far as the suction end of the cooling air blower.

4. An internal combustion engine according to claim 3, with a sidewall of the encasing located in front of the surface of the engine comprising the suction pipe, further comprising a partition arranged within the encasing and in parallel relation to said sidewall of the encasing, said chamber being formed between the sidewall of the encasing and the partition, said cooling air filter being plate-shaped and arranged in the chamber between the sidewall of the encasing and the partition in parallel relation to both these walls, an aperture provided in said partition and terminating in the suction pipe of the engine, said suction air filter being designed as an annular fine-mesh filter and arranged in the chamber in front of said aperture of the partition in concentric relation to this aperture.

* * * * *